US010847089B2

(12) United States Patent
Jeong et al.

(10) Patent No.: US 10,847,089 B2
(45) Date of Patent: Nov. 24, 2020

(54) DISPLAY DEVICE AND METHOD OF DRIVING A DISPLAY PANEL

(71) Applicant: Samsung Display Co., Ltd., Yongin-si (KR)

(72) Inventors: Heesoon Jeong, Hwaseong-si (KR); Jaekeun Lim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/245,978

(22) Filed: Jan. 11, 2019

(65) Prior Publication Data

US 2019/0221159 A1 Jul. 18, 2019

(30) Foreign Application Priority Data

Jan. 16, 2018 (KR) ..... 10-2018-0005769

(51) Int. Cl.

| | |
|---|---|
| ***G09G 5/00*** | (2006.01) |
| ***G09G 3/3233*** | (2016.01) |
| ***G09G 3/3266*** | (2016.01) |
| ***G09G 3/3275*** | (2016.01) |
| *G09G 3/20* | (2006.01) |

(52) U.S. Cl.

CPC ..... *G09G 3/3233* (2013.01); *G09G 3/3266* (2013.01); *G09G 3/3275* (2013.01); *G09G 3/2014* (2013.01); *G09G 2300/0842* (2013.01); *G09G 2310/0205* (2013.01); *G09G 2310/0278* (2013.01); *G09G 2310/061* (2013.01); *G09G 2320/0233* (2013.01); *G09G 2320/064* (2013.01); *G09G 2360/16* (2013.01)

(58) Field of Classification Search

None

See application file for complete search history.

(56) References Cited

U.S. PATENT DOCUMENTS

2005/0099412 A1* 5/2005 Kasai ..... G09G 3/325 345/204
2005/0212787 A1* 9/2005 Noguchi ..... G09G 3/3233 345/204
2010/0309194 A1* 12/2010 Shin ..... H05B 45/20 345/214

FOREIGN PATENT DOCUMENTS

KR 10-0599470 B1 7/2006
KR 10-1056281 B1 8/2011

(Continued)

*Primary Examiner* — Carl Adams

(74) *Attorney, Agent, or Firm* — Lewis Roca Rothgerber Christie LLP

(57) ABSTRACT

A display device includes a display panel including a plurality of pixel circuits each having a light-emitting element, the display panel being divided into a plurality of display regions comprising respective groups of the pixel circuits, and a display panel driving circuit configured to drive the display panel by sequentially performing an emission preparation operation, a scan operation, and an emission operation for the pixel circuits, and configured to perform the emission operation independently on each of the display regions, wherein, in each frame, the display panel driving circuit is configured to calculate a region grayscale that each of the display regions is to implement by analyzing grayscale data to be applied to the pixel circuits in each of the display regions, and to change a length of an emission period for each of the display regions based on the calculated region grayscale, the emission operation being performed in the emission period.

14 Claims, 10 Drawing Sheets

(56) References Cited

FOREIGN PATENT DOCUMENTS

| | | | |
|---|---|---|---|
| KR | 10-2012-0028426 | A | 3/2012 |
| KR | 10-2012-0114988 | A | 10/2012 |
| KR | 10-2014-0111502 | A | 9/2014 |

* cited by examiner

DISPLAY DEVICE AND METHOD OF DRIVING A DISPLAY PANEL

CROSS-REFERENCE TO RELATED APPLICATION

This application claims priority to, and the benefit of, Korean Patent Application No. 10-2018-0005769, filed on Jan. 16, 2018 in the Korean Intellectual Property Office (KIPO), the contents of which are incorporated herein in its entirety by reference.

BACKGROUND

1. Field

Embodiments described herein relate to a display device (e.g., an organic light emitting display device, etc.) that operates based on a simultaneous emission driving technique, and a method of driving a display panel included in the display device.

2. Description of the Related Art

Recently, an organic light emitting display device has been spotlighted as a display device included in an electronic device. In the organic light emitting display device, each pixel circuit may implement (or, represent) a grayscale using a data voltage stored in a storage capacitor included in the pixel circuit. Here, a technique for driving the organic light emitting display device may be divided (or, classified) into a sequential emission driving technique and a simultaneous emission driving technique.

Generally, an organic light emitting display device that operates based on the simultaneous emission driving technique may sequentially perform an emission preparation operation (e.g., the emission preparation operation includes at least one selected from an on-bias operation, an initialization operation, a reset operation, and a threshold voltage compensation operation), a scan operation, and an emission operation for the pixel circuits. Here, the emission preparation operation may be performed on all of the pixel circuits at the same time, and the emission operation may be performed on all of the pixel circuits at the same time, whereas the scan operation may be performed on the pixel circuits in a sequence of scan-lines.

When the pixel circuit implements the grayscale using the data voltage stored in the storage capacitor, a length of an emission period (e.g., an emission time or an emission duration) where the emission operation is performed may affect an emission-luminance of the pixel circuit. For example, when the organic light emitting display device operates based on the simultaneous emission driving technique in which the length of the emission period is set to be relatively long, the pixel circuit may achieve relatively high emission-luminance in implementing a specific grayscale. In this case, however, the pixel circuit may consume relatively high power.

On the other hand, when the organic light emitting display device operates based on the simultaneous emission driving technique in which the length of the emission period is set to be relatively short, the pixel circuit may consume relatively low power in implementing the specific grayscale. In this case, however, the pixel circuit may achieve relatively low emission-luminance.

SUMMARY

Some embodiments provide a display device that can change (or, vary), in each frame, a length of an emission period (e.g., an emission time) in which an emission operation is performed for each of display regions that are formed by grouping pixel circuits included in a display panel.

Some embodiments provide a method of driving a display panel that can change, in each frame, a length of an emission period in which an emission operation is performed for each of display regions that are formed by grouping pixel circuits included in the display panel.

According to an aspect of embodiments, a display device includes a display panel including a plurality of pixel circuits each having a light-emitting element, the display panel being divided into a plurality of display regions including respective groups of the pixel circuits, and a display panel driving circuit configured to drive the display panel by sequentially performing an emission preparation operation, a scan operation, and an emission operation for the pixel circuits, and configured to perform the emission operation independently on each of the display regions, wherein, in each frame, the display panel driving circuit is configured to calculate a region grayscale that each of the display regions is to implement by analyzing grayscale data to be applied to the pixel circuits in each of the display regions, and to change a length of an emission period for each of the display regions based on the calculated region grayscale, the emission operation being performed in the emission period.

The display panel driving circuit may be configured to increase the length of the emission period for each of the display regions as the region grayscale increases, and may be configured to decrease the length of the emission period for each of the display regions as the region grayscale decreases.

The display panel driving circuit may be configured to connectively perform the scan operation on the display regions that are adjacent to each other in a scan direction.

The display panel driving circuit may be configured to set a starting point of the emission period for each of the display regions to a same point, and may be configured to move an ending point of the emission period for each of the display regions based on the region grayscale.

The display panel driving circuit may be configured to separately perform the scan operation on the display regions that are adjacent to each other in a scan direction.

The display panel driving circuit may be configured to set a starting point of the emission period for each of the display regions to a same point, and may be configured to move an ending point of the emission period for each of the display regions based on the region grayscale.

The display panel driving circuit may be configured to set an ending point of the emission period for each of the display regions to a same point, and may be configured to move a starting point of the emission period for each of the display regions based on the region grayscale.

The display panel driving circuit may be configured to move both a starting point and an ending point of the emission period for each of the display regions based on the region grayscale.

The display panel driving circuit may be configured to linearly increase or linearly decrease the length of the emission period for each of the display regions.

The display panel driving circuit may be configured to non-linearly increase or non-linearly decrease the length of the emission period for each of the display regions.

The display panel driving circuit may be configured to discretely increase or discretely decrease the length of the emission period for each of the display regions.

The display panel driving circuit may be configured to calculate a difference between the region grayscale and a reference grayscale, and may be configured to determine the length of the emission period for each of the display regions based on the difference.

The display panel driving circuit may be configured to calculate the region grayscale as an average value of grayscales that the pixel circuits in each of the display regions are to implement.

The display panel driving circuit may be configured to calculate the region grayscale as a weighted average value of grayscales that the pixel circuits in each of the display regions are to implement.

The display panel driving circuit may be configured to calculate the region grayscale as a minimum value of grayscales that the pixel circuits in each of the display regions are to implement.

The display panel driving circuit may be configured to calculate the region grayscale as a maximum value of grayscales that the pixel circuits in each of the display regions are to implement.

According to an aspect of embodiments, there is provided a method of driving a display panel that includes a plurality of display regions including respective groups of a plurality of pixel circuits in the display panel, where the display panel is driven by sequentially performing an emission preparation operation, a scan operation, and an emission operation for the pixel circuits, the method including calculating a region grayscale that each of the display regions is to implement by analyzing grayscale data to be applied to the pixel circuits in each of the display regions, comparing the region grayscale with a reference grayscale, increasing a length of an emission period for each of the display regions by a change-amount corresponding to a difference between the region grayscale and the reference grayscale when the region grayscale is higher than the reference grayscale, the emission operation being performed in the emission period, determining the length of the emission period for each of the display regions as a reference length when the region grayscale is equal to the reference grayscale, and decreasing the length of the emission period for each of the display regions by the change-amount corresponding to the difference between the region grayscale and the reference grayscale when the region grayscale is lower than the reference grayscale.

The method may further include fixing a starting point of the emission period for each of the display regions, and moving an ending point of the emission period for one or more of the display regions to increase or decrease the length of the emission period thereof.

The method may further include fixing an ending point of the emission period for each of the display regions, and moving a starting point of the emission period for one or more of the display regions to increase or decrease the length of the emission period thereof.

The method may further include moving both a starting point and an ending point of the emission period for one or more of the display regions to increase or decrease the length of the emission period thereof.

Accordingly, a display device according to one or more embodiments may drive a display panel including display regions, where the display regions are formed by grouping pixel circuits included in the display panel, by sequentially performing an emission preparation operation, a scan operation, and an emission operation for the pixel circuits. Here, in each frame, the display device may calculate a region grayscale that each of the display regions is to implement by analyzing grayscale data to be applied to the pixel circuits included in each of the display regions, and may change a length of an emission period for each of the display regions based on the region grayscale that each of the display regions is to implement (e.g., may increase the length of the emission period for each of the display regions as the region grayscale that each of the display regions is to implement increases, and may decrease the length of the emission period for each of the display regions as the region grayscale that each of the display regions is to implement decreases).

Thus, the display device may achieve high luminance by increasing an emission time for a display region that implements a high grayscale, and may reduce power consumption by decreasing the emission time for a display region that implements a low grayscale. As a result, the display device may display a high-quality image having an improved contrast ratio while reducing or minimizing unnecessary power consumption.

In addition, a method of driving a display panel according to one or more embodiments may drive the display panel including display regions, where the display regions are formed by grouping pixel circuits included in the display panel, by sequentially performing an emission preparation operation, a scan operation, and an emission operation for the pixel circuits. Here, in each frame, the method may calculate a region grayscale that each of the display regions is to implement by analyzing grayscale data to be applied to the pixel circuits included in each of the display regions, and may change a length of an emission period for each of the display regions based on the region grayscale that each of the display regions is to implement.

Thus, the method may achieve high luminance by increasing an emission time for a display region that implements a high grayscale, and may reduce power consumption by decreasing the emission time for a display region that implements a low grayscale. As a result, the method may allow a high-quality image having an improved contrast ratio to be displayed on the display panel while reducing or minimizing unnecessary power consumption.

BRIEF DESCRIPTION OF THE DRAWINGS

Illustrative, non-limiting embodiments will be more clearly understood from the following detailed description in conjunction with the accompanying drawings.

DETAILED DESCRIPTION

Figure 1:
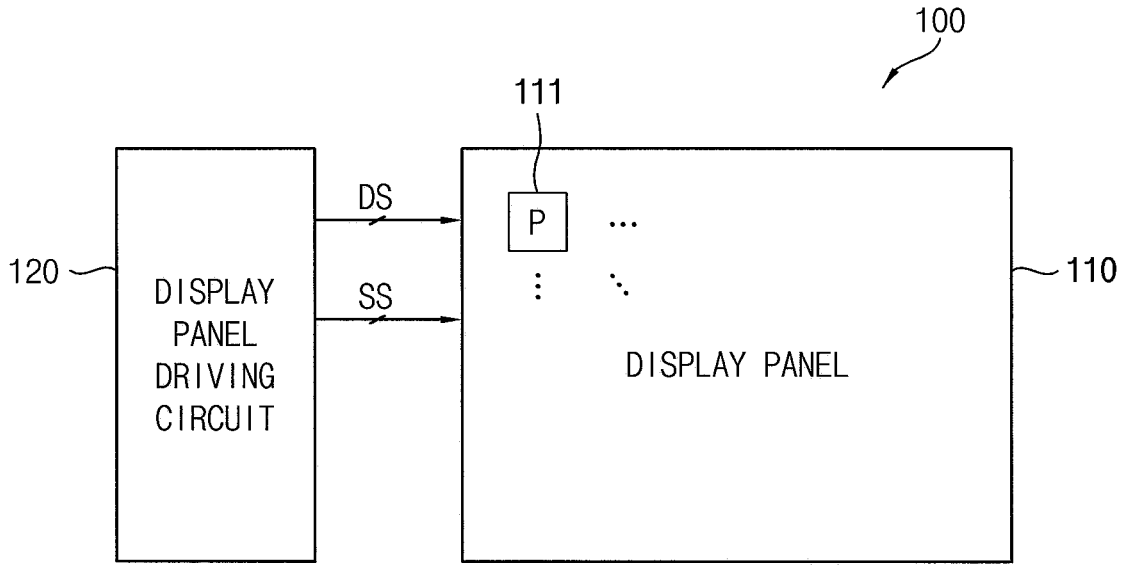
FIG. 1 is a block diagram illustrating a display device according to one or more embodiments.

Features of the inventive concept and methods of accomplishing the same may be understood more readily by reference to the following detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present invention.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to one or more embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
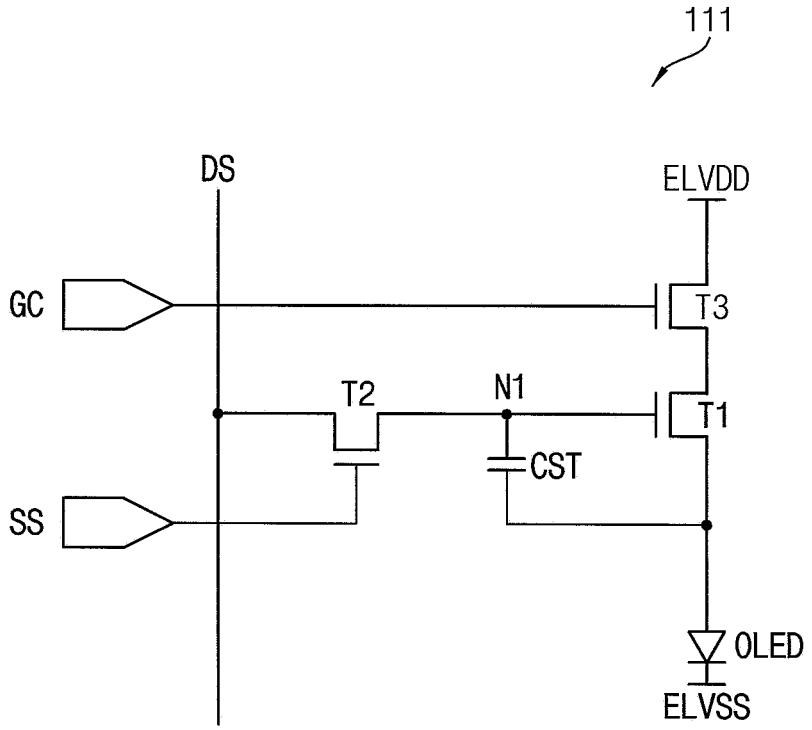
FIG. 2 is a circuit diagram illustrating an example of a pixel circuit included in the display device of FIG. 1.
Figure 3:
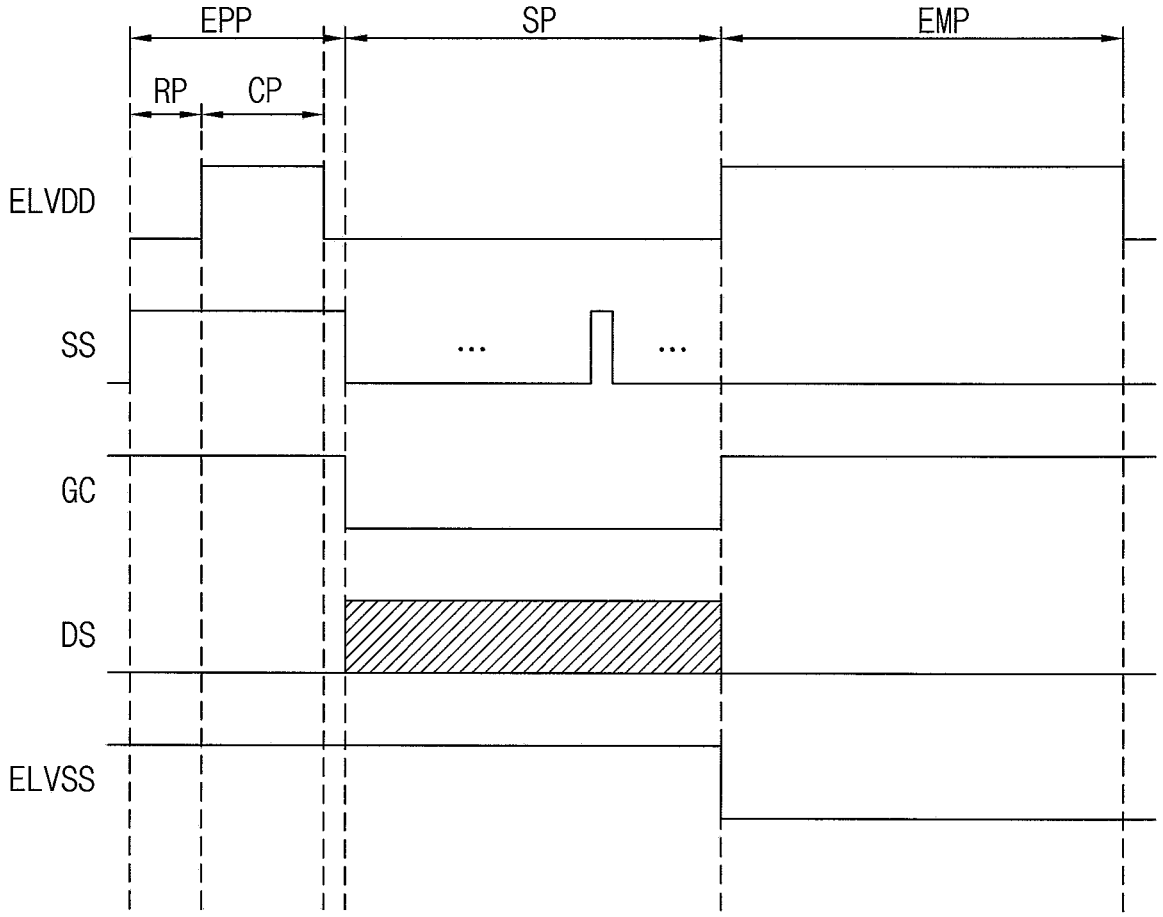
FIG. 3 is a waveform diagram illustrating an operating period of the pixel circuit of FIG. 2.
Figure 4:
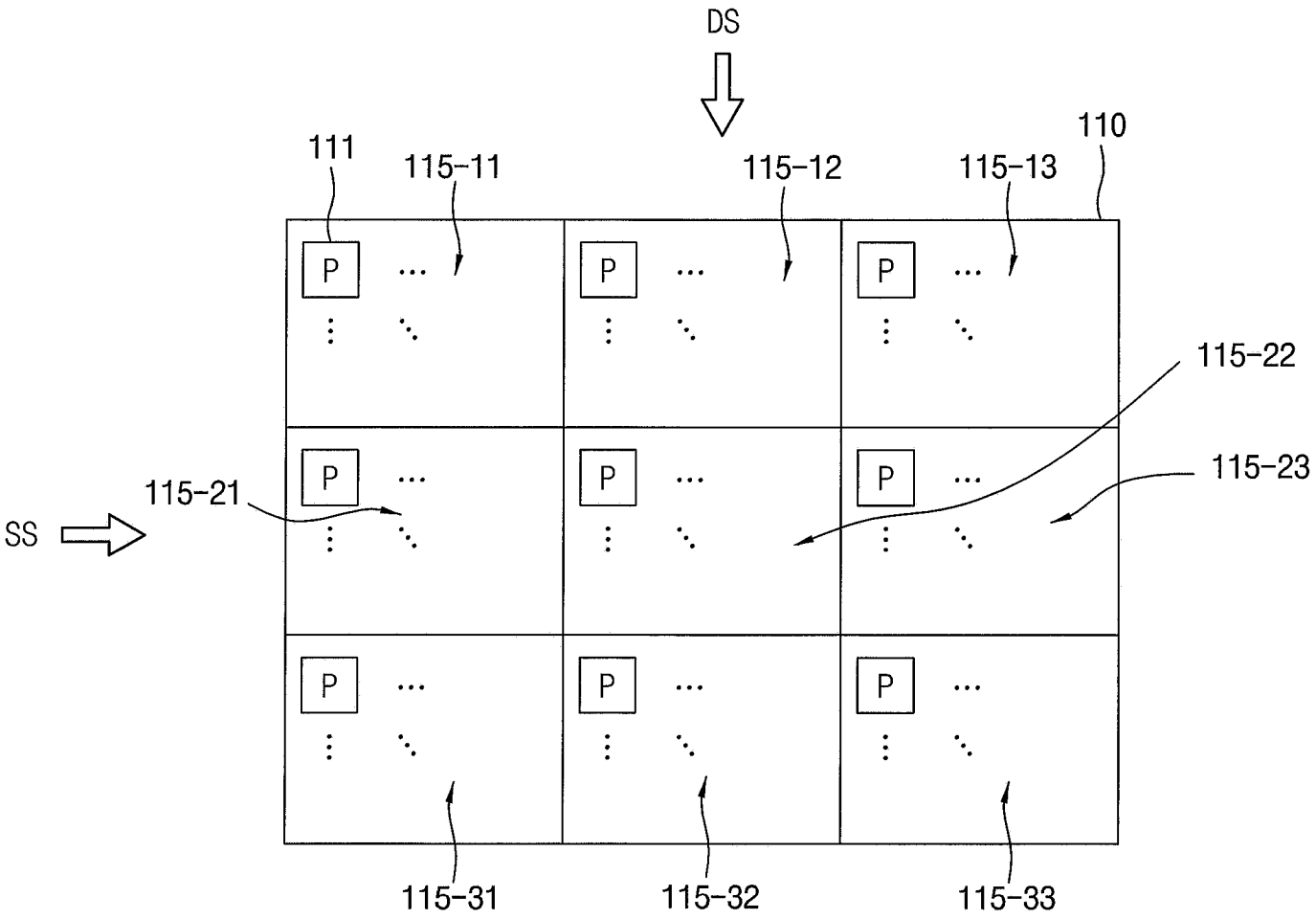
FIG. 4 is a diagram illustrating an example in which display regions are formed in a display panel included in the display device of FIG. 1.
Figure 5:
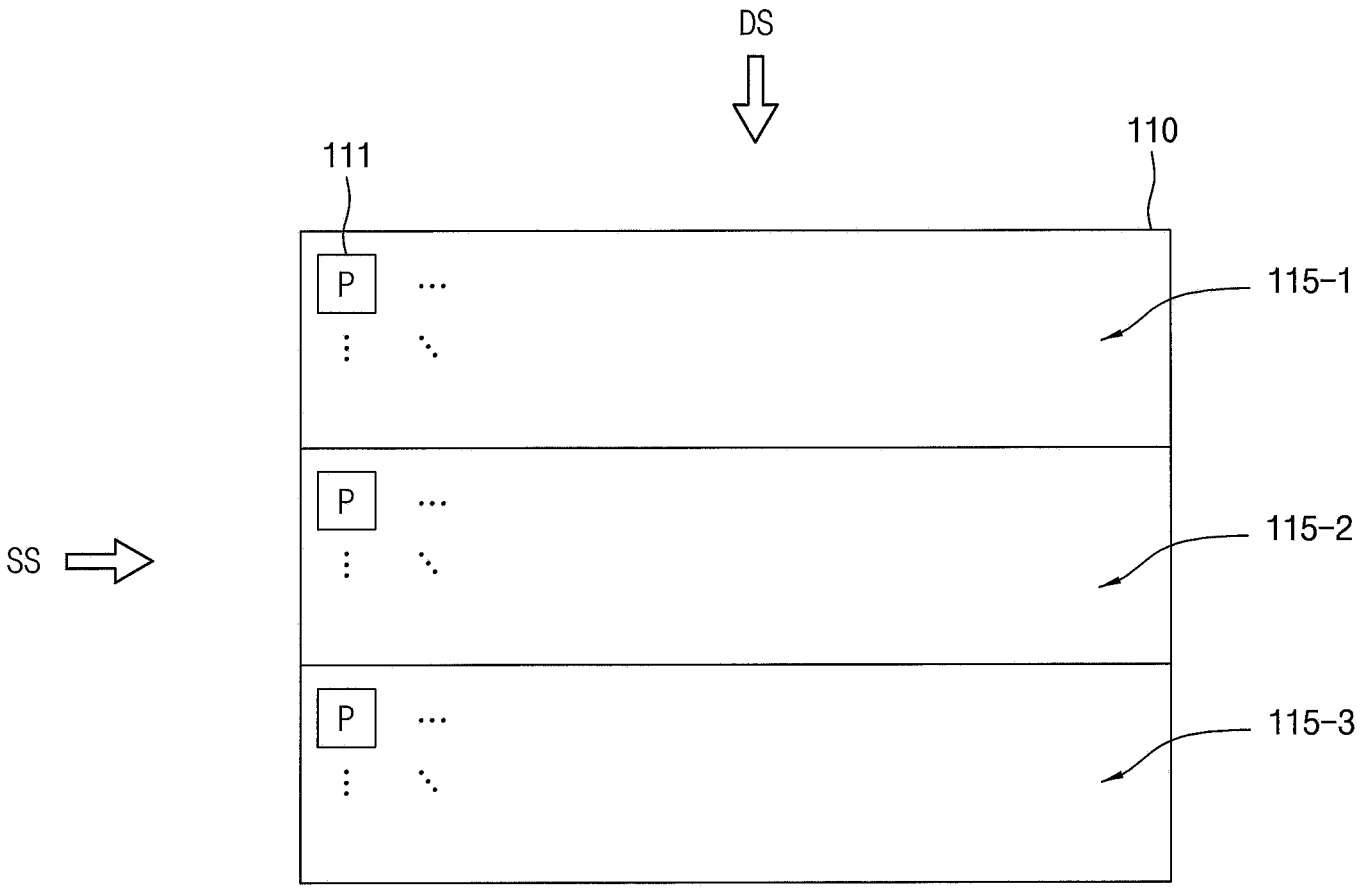
FIG. 5 is a diagram illustrating another example in which display regions are formed in a display panel included in the display device of FIG. 1.

FIG. 1 is a block diagram illustrating a display device according to one or more embodiments, FIG. 2 is a circuit diagram illustrating an example of a pixel circuit included in the display device of FIG. 1, FIG. 3 is a waveform diagram illustrating an operating period of the pixel circuit of FIG. 2, FIG. 4 is a diagram illustrating an example in which display regions are formed in a display panel included in the display device of FIG. 1, and FIG. 5 is a diagram illustrating another example in which display regions are formed in a display panel included in the display device of FIG. 1.

Referring to FIGS. 1 to 5, the display device 100 may include a display panel 110 and a display panel driving circuit 120. Here, the display device 100 may operate based on a simultaneous emission driving technique. For example, the display device 100 may be an organic light emitting display device. However, the display device 100 is not limited thereto.

The display panel 110 may include a plurality of pixel circuits 111 each having a light-emitting element. For example, when the display device 100 is an organic light emitting display device, the light-emitting element may be an organic light emitting diode OLED. In an embodiment, the pixel circuits 111 may be arranged in a matrix form in the display panel 110. However, an arrangement of the pixel circuits 111 is not limited thereto. In one or more embodiments, the display panel 110 may be divided into a plurality of display regions 115. That is, the display regions 115 may be formed by grouping respective ones of the pixel circuits 111.

In an embodiment, as illustrated in FIG. 4, the display regions 115-11 through 115-33 of the display panel 110 may be formed by grouping the pixel circuits 111 both in a direction in which a scan-line for transmitting a scan signal SS extends and in a direction in which a data-line for transmitting a data signal DS extends. Here, in the display panel 110, a scan operation may be connectively performed on the display regions 115-11 through 115-33 that are adjacent to each other in a scan direction (e.g., in the direction in which the data-line for transmitting the data signal DS extends). In this case, the scan operation may be performed on the display regions 115-21, 115-22, and 115-23 (e.g., a middle display region) after the scan operation is performed on the display regions 115-11, 115-12, and 115-13 (e.g., an upper display region). Further, the scan operation may be performed on the display regions 115-31, 115-32, and 115-33 (e.g., a lower display region) after the scan operation is performed on the display regions 115-21, 115-22, and 115-23 (e.g., the middle display region).

Alternatively, in the display panel 110, the scan operation may be separately performed on the display regions 115-11 through 115-33 that are adjacent to each other in the scan direction. In this case, the scan operation may be simultaneously or concurrently performed on the display regions 115-11, 115-12, and 115-13 (e.g., the upper display region), the display regions 115-21, 115-22, and 115-23 (e.g., the middle display region), and the display regions 115-31, 115-32, and 115-33 (e.g., the lower display region).

In another embodiment, as illustrated in FIG. 5, the display regions 115-1 through 115-3 of the display panel 110 may be formed by grouping the pixel circuits 111 in the direction in which the data-line for transmitting the data signal DS extends. Here, in the display panel 110, the scan operation may be connectively performed on the display regions 115-1 through 115-3 that are adjacent to each other in the scan direction. In this case, the scan operation may be performed on the display region 115-2 after the scan operation is performed on the display region 115-1, and the scan operation may be performed on the display region 115-3 after the scan operation is performed on the display region 115-2.

Alternatively, in the display panel 110, the scan operation may be separately performed on the display regions 115-1 through 115-3 that are adjacent to each other in the scan direction. In this case, the scan operation may be simultaneously or concurrently performed on the display region 115-1, the display region 115-2, and the display region 115-3.

The display panel driving circuit 120 may drive the display panel 110 by sequentially performing the emission preparation operation, the scan operation, and the emission operation on the pixel circuits 111. In other words, the display panel driving circuit 120 may drive the display panel 110 based on a simultaneous emission driving technique. For this operation, the display panel driving circuit 120 may include a data driver, a scan driver, an emission controller, a timing controller, a power supply, etc. Because the structure of the display panel driving circuit 120 is an example, elements of the display panel driving circuit 120 are not limited thereto.

The display panel driving circuit 120 may simultaneously or concurrently perform the emission preparation operation on all of the pixel circuits 111 included in the display panel 110. Generally, the emission preparation operation includes an on-bias operation, an initialization operation, a reset operation, a threshold voltage compensation operation, etc. That is, the emission preparation operation may include at least one selected from the on-bias operation, the initialization operation, the reset operation, the threshold voltage compensation operation, etc. according to a structure of the pixel circuit 111. In an embodiment, the display panel driving circuit 120 may sequentially perform the scan operation on the pixel circuits 111 included in the display panel 110 in the scan direction (e.g., in a sequence of scan-lines).

In another embodiment, the display panel driving circuit 120 may sequentially perform the scan operation on the pixel circuits 111 included in respective display regions 115 of the display panel 110 in the scan direction. For example, when the display panel driving circuit 120 performs the scan operation independently on respective display regions 115 of the display panel 110, the scan operation may be performed on all of the display regions 115 at the same time (e.g., in parallel). The display panel driving circuit 120 may perform the emission operation independently on respective display regions 115 of the display panel 110. Thus, the emission operation may be simultaneously or concurrently performed on the pixel circuits 111 included in respective display regions 115 of the display panel 110. In other words, because the pixel circuits 111 included in one display region 115 simultaneously or concurrently emit light independently of the pixel circuits 111 included in another display region 115, the emission operation of one display region 115 might not affect the emission operation of another display region 115. Thus, the display panel driving circuit 120 may provide independent emission control signals GC to the display regions 115 of the display panel 110, respectively, and the pixel circuits 111 included in each of the display regions 115 may simultaneously or concurrently perform the emission operation (e.g., may emit light at the same time, and may emit no light at the same time) in response to the emission control signal GC provided to each of the display regions 115.

For example, as illustrated in FIG. 4, the pixel circuits 111 included in the first display region 115-11 may simultaneously or concurrently perform the emission operation in response to the first emission control signal GC provided to the first display region 115-11, the pixel circuits 111 included in the second display region 115-22 may simultaneously or concurrently perform the emission operation in response to the second emission control signal GC provided to the second display region 115-22, and the pixel circuits 111 included in the third display region 115-33 may simultaneously or concurrently perform the emission operation in response to the third emission control signal GC provided to the third display region 115-33.

As another example, as illustrated in FIG. 5, the pixel circuits 111 included in the first display region 115-1 may simultaneously or concurrently perform the emission operation in response to the first emission control signal GC provided to the first display region 115-1, the pixel circuits 111 included in the second display region 115-2 may simultaneously or concurrently perform the emission operation in response to the second emission control signal GC provided to the second display region 115-2, and the pixel circuits 111 included in the third display region 115-3 may simultaneously or concurrently perform the emission operation in response to the third emission control signal GC provided to the third display region 115-3.

In an embodiment, as illustrated in FIGS. 2 and 3, the pixel circuit 111 may include a first transistor T1, a second transistor T2, a third transistor T3, a storage capacitor CST, and an organic light emitting diode OLED. That is, because the pixel circuit 111 includes three transistors T1, T2, and T3 and one capacitor CST, the pixel circuit 111 may be referred to as a so-called 3T-1C pixel circuit. Here, the pixel circuit 111 may sequentially perform the emission preparation operation (e.g., including the reset operation and the threshold voltage compensation operation), the scan operation, and the emission operation. The first transistor T1 may include a gate terminal that is connected to a first node N1, a first terminal that is connected to the third transistor T3, and a second terminal that is connected to the organic light emitting diode OLED. Here, the first transistor T1 may be turned on in response to the data signal DS stored in the storage capacitor CST to control a current flowing through the organic light emitting diode OLED. Thus, the first transistor T1 may be referred to as a driving transistor.

The second transistor T2 may include a gate terminal that is connected to the scan-line for transmitting the scan signal SS, a first terminal that is connected to the data-line for transmitting the data signal DS, and a second terminal that is connected to the first node N1. Here, the second transistor T2 may be turned on in response to the scan signal SS to transfer the data signal DS to the first node N1. Thus, the second transistor T2 may be referred to as a switching transistor.

The third transistor T3 may include a gate terminal that is connected to an emission control-line for transmitting the emission control signal GC, a first terminal that is connected to a first power voltage ELVDD, and a second terminal that is connected to the first transistor T1. Here, the third transistor T3 may be turned on in response to the emission control signal GC to allow the organic light emitting diode OLED to emit light. Thus, the third transistor T3 may be referred to as an emission control transistor.

The storage capacitor CST may be connected between the first node N1 and an anode of the organic light emitting diode OLED. Here, the storage capacitor CST may store the data signal DS applied via the data-line when the second transistor T2 is turned on in a scan period SP where the scan operation is performed.

The organic light emitting diode OLED may include the anode that is connected to the first transistor T1, and a cathode that is connected to a second power voltage ELVSS. Here, the organic light emitting diode OLED may emit light when the first transistor T1 and the third transistor T3 are turned on in an emission period EMP where the emission operation is performed.

Although it is illustrated in FIG. 2 that the first through third transistors T1, T2, and T3 are n-type metal oxide semiconductor (NMOS) transistors, the first through third transistors T1, T2, and T3 are not limited thereto. For example, the first through third transistors T1, T2, and T3 may be p-type metal oxide semiconductor (PMOS) transistors, or may be a combination of the NMOS transistors and the PMOS transistors.

For example, as for an operation of the pixel circuit 111 included in the display panel 110, an operating period of the pixel circuit 111 included in the display panel 110 may include an emission preparation period EPP where the emission preparation operation is performed, the scan period SP where the scan operation is performed, and the emission period EMP where the emission operation is performed.

Here, the emission preparation period EPP may include a reset period RP where the reset operation is performed, and a threshold voltage compensation period CP where the threshold voltage compensation operation is performed. First, in the reset period RP, the first power voltage ELVDD may have a low voltage level, the second power voltage ELVSS may have a high voltage level, the scan signal SS may have a high voltage level, and the emission control signal GC may have a high voltage level. Thus, the gate terminal of the first transistor T1, which is connected to the first node N1, and the anode of the organic light emitting diode OLED may be reset, so that desired luminance may be implemented regardless of the data signal DS that is provided in a previous frame. Subsequently, in the threshold voltage compensation period CP, the first power voltage ELVDD may have a high voltage level, the second power voltage ELVSS may have a high voltage level, the scan signal SS may have a high voltage level, and the emission control signal GC may have a high voltage level. Thus, a voltage to which a threshold voltage of the first transistor T1 is reflected may be stored in the first node N1 (e.g., at the gate terminal of the first transistor T1), so that characteristic deviation due to the threshold voltage of the first transistor T1 may be reduced or eliminated.

Next, in the scan period SP, the first power voltage ELVDD may have a low voltage level, the second power voltage ELVSS may have a high voltage level, the scan signal SS may have a high voltage level when the data signal DS is applied to the pixel circuits 111 corresponding to a given scan-line, and the emission control signal GC may have a low voltage level. Thus, the second transistor T2 may be turned on when the data signal DS is applied to the pixel circuits 111 corresponding to the given scan-line, so that the data signal DS may be stored in the storage capacitor CST while the second transistor T2 is turned on.

Subsequently, in the emission period EMP, the first power voltage ELVDD may have a high voltage level, the second power voltage ELVSS may have a low voltage level, the scan signal SS may have a low voltage level, and the emission control signal GC may have a high voltage level. Thus, the first transistor T1 and the third transistor T3 may be turned on, so that the organic light emitting diode OLED may emit light as a current flows through the organic light emitting diode OLED.

As described above, each pixel circuit 111 may implement a grayscale using the data signal DS (e.g., a data voltage) stored in the storage capacitor CST. Because a structure and an operation of the pixel circuit 111 illustrated in FIGS. 2 and 3 are examples, the structure and the operation of the pixel circuit 111 are not limited thereto.

A length of the emission period EMP (e.g., an emission time) may affect emission-luminance of the pixel circuit 111. For example, when the length of the emission period EMP is set to be relatively long, the pixel circuit 111 may achieve relatively high emission-luminance when implementing a specific grayscale. On the other hand, when the length of the emission period EMP is set to be relatively short, the pixel circuit 111 may achieve relatively low emission-luminance when implementing a specific grayscale. However, if the emission time is set to be long regardless of a grayscale which the pixel circuit 111 is to implement, the emission-luminance of the pixel circuit 111 may be increased even when the pixel circuit 111 implements a low grayscale. Thus, a contrast ratio of an image displayed on the display panel 110 may be degraded, and power consumption for driving the display panel 110 may be unnecessarily increased. On the other hand, if the emission time is set to be short regardless of a grayscale which the pixel circuit 111 is to implement, the emission-luminance of the pixel circuit 111 may be decreased even when the pixel circuit 111 implements a high grayscale. Thus, the contrast ratio of the image displayed on the display panel 110 may be degraded.

To solve these problems, in each frame, the display panel driving circuit 120 may calculate a region grayscale that each of the display regions 115 of the display panel 110 is to implement by analyzing grayscale data to be applied to the pixel circuits 111 included in each of the display regions 115 of the display panel 110, and may change the length of the emission period EMP for each of the display regions 115 of the display panel 110 based on the region grayscale, where the emission operation is performed in the emission period EMP. For example, the display panel driving circuit 120 may increase the length of the emission period EMP for each of the display regions 115 as the region grayscale that each of the display regions 115 is to implement increases. On the other hand, the display panel driving circuit 120 may decrease the length of the emission period EMP for each of the display regions 115 as the region grayscale that each of the display regions 115 is to implement decreases.

In an embodiment, the display panel driving circuit 120 may linearly increase or decrease the length of the emission period EMP for each of the display regions 115 based on the region grayscale that each of the display regions 115 is to implement. In this case, the length of the emission period EMP may be increased or decreased at the same rate in an entire grayscale range of the region grayscale.

In another embodiment, the display panel driving circuit 120 may non-linearly increase or decrease the length of the emission period EMP for each of the display regions 115 based on the region grayscale that each of the display regions 115 is to implement. In this case, the length of the emission period EMP may be sharply increased or decreased in a particular grayscale range of the region grayscale, and the length of the emission period EMP may be gradually increased or decreased in another particular grayscale range of the region grayscale.

In still another embodiment, the display panel driving circuit 120 may discretely increase or decrease the length of the emission period EMP for each of the display regions 115 based on the region grayscale that each of the display regions 115 is to implement. In this case, the length of the emission period EMP may be increased or decreased in a stepwise form based on the region grayscale.

As described above, in each frame, the display panel driving circuit 120 may change the length of the emission period EMP for each of the display regions 115 that are formed by grouping the pixel circuits 111 included in the display panel 110. In an embodiment, when the display panel driving circuit 120 connectively performs the scan operation on the display regions 115 that are adjacent to each other in the scan direction, the length of the emission period EMP for each of the display regions 115 may be changed by moving an ending point of the emission period EMP for each of the display regions 115 based on the region grayscale that each of the display regions 115 is to implement. This embodiment will be described in detail with reference to FIGS. 6 and 7.

In another embodiment, when the display panel driving circuit 120 separately performs the scan operation on the display regions 115 that are adjacent to each other in the scan direction, the length of the emission period EMP for each of the display regions 115 may be changed by moving a starting point of the emission period EMP for each of the display regions 115 based on the region grayscale that each of the display regions 115 is to implement, by moving an ending point of the emission period EMP for each of the display regions 115 based on the region grayscale that each of the display regions 115 is to implement, or by moving both the starting point and the ending point based on the region grayscale that each of the display regions 115 is to implement. This embodiment will be described in detail with reference to FIGS. 8 and 11.

In one or more embodiments, the display panel driving circuit 120 may calculate the region grayscale that each of the display regions 115 is to implement by analyzing the grayscale data to be applied to the pixel circuits 111 included in each of the display regions 115. In an embodiment, the display panel driving circuit 120 may calculate the region grayscale that each of the display regions 115 is to implement as an average value of grayscales that the pixel circuits 111 included in each of the display regions 115 are to implement. In another embodiment, the display panel driving circuit 120 may calculate the region grayscale that each of the display regions 115 is to implement as a weighted average value of grayscales that the pixel circuits 111 included in each of the display regions 115 are to implement. In still another embodiment, the display panel driving circuit 120 may calculate the region grayscale that each of the display regions 115 is to implement as a minimum value of grayscales that the pixel circuits 111 included in each of the display regions 115 are to implement. In still another embodiment, the display panel driving circuit 120 may calculate the region grayscale that each of the display regions 115 is to implement as a maximum value of grayscales that the pixel circuits 111 included in each of the display regions 115 are to implement. However, the region grayscale that each of the display regions 115 is to implement may be calculated in various ways. For example, a checksum algorithm may be used in calculating the region grayscale that each of the display regions 115 is to implement.

In one or more embodiments, the display panel driving circuit 120 may calculate a difference between the region grayscale that each of the display regions 115 is to implement and a reference grayscale, and may determine the length of the emission period EMP for each of the display regions 115 based on the calculated difference. For example, when the region grayscale that each of the display regions 115 is to implement is higher than the reference grayscale, the display panel driving circuit 120 may increase the length of the emission period EMP by a change-amount corresponding to the calculated difference. On the other hand, when the region grayscale that each of the display regions 115 is to implement is lower than the reference grayscale, the display panel driving circuit 120 may decrease the length of the emission period EMP by the change-amount corresponding to the calculated difference. In addition, when the region grayscale that each of the display regions 115 is to implement is equal to the reference grayscale, the display panel driving circuit 120 may determine the length of the emission period EMP for each of the display regions 115 as a reference length.

As described above, the display device 100 may drive the display panel 110 including the display regions 115, where the display regions 115 are formed by grouping the pixel circuits 111 included in the display panel 110, by sequentially performing the emission preparation operation, the scan operation, and the emission operation for the pixel circuits 111. Here, in each frame, the display device 100 may calculate the region grayscale that each of the display regions 115 is to implement by analyzing the grayscale data to be applied to the pixel circuits 111 included in each of the display regions 115, and may change the length of the emission period EMP for each of the display regions 115 based on the region grayscale that each of the display regions 115 is to implement (e.g., may increase the length of the emission period EMP for each of the display regions 115 as the region grayscale that each of the display regions 115 is to implement increases, and may decrease the length of the emission period EMP for each of the display regions 115 as the region grayscale that each of the display regions 115 is to implement decreases).

Thus, the display device 100 may achieve high luminance by increasing the emission time for the display region 115 that implements a high grayscale, and may reduce power consumption by decreasing the emission time for the display region 115 that implements a low grayscale. As a result, the display device 100 may display a high-quality image having an improved contrast ratio while reducing or minimizing unnecessary power consumption.

Figure 6:
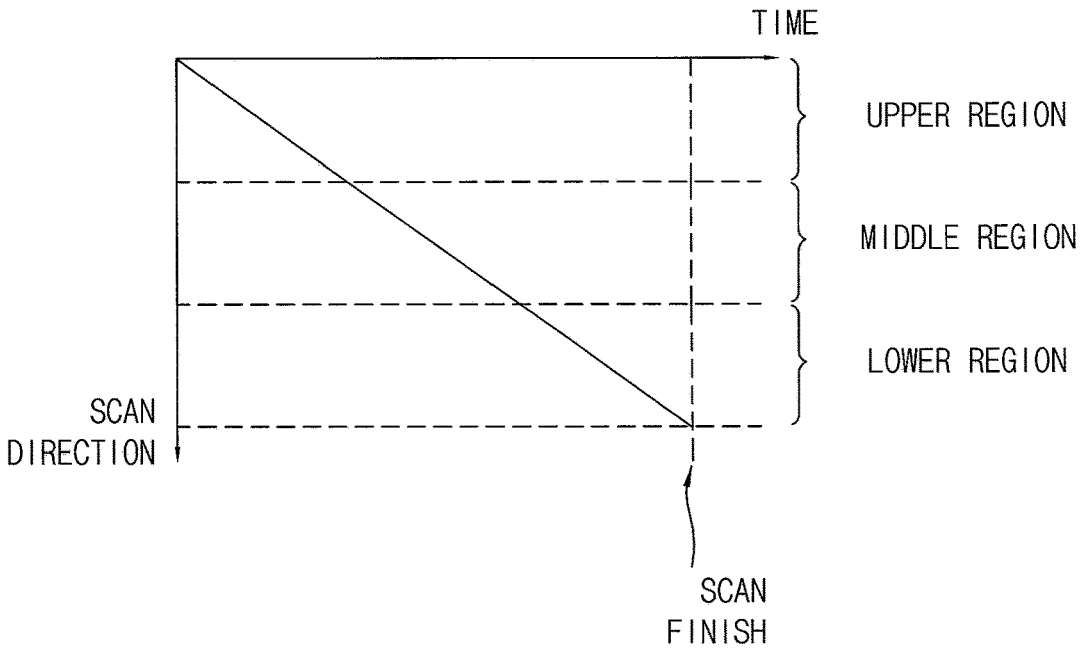
FIG. 6 is a diagram for describing that a display panel driving circuit included in the display device of FIG. 1 connectively performs a scan operation on display regions that are adjacent to each other in a scan direction.
Figure 7:
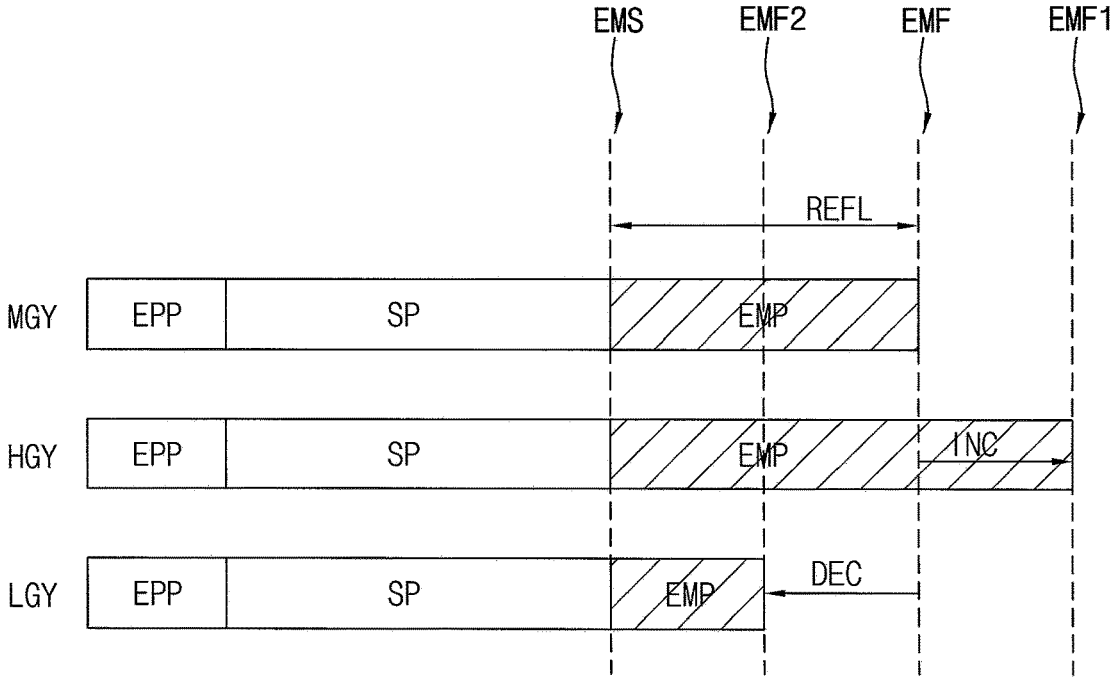
FIG. 7 is a diagram illustrating an example in which a display panel driving circuit included in the display device of FIG. 1 changes a length of an emission period for each of display regions that are adjacent to each other in a scan direction when connectively performing a scan operation on the display regions.

FIG. 6 is a diagram for describing that a display panel driving circuit included in the display device of FIG. 1 connectively performs a scan operation on display regions that are adjacent to each other in a scan direction, and FIG. 7 is a diagram illustrating an example in which a display panel driving circuit included in the display device of FIG. 1 changes a length of an emission period for each of display regions that are adjacent to each other in a scan direction when connectively performing a scan operation on the display regions.

Referring to FIGS. 6 and 7, the display panel driving circuit 120 may connectively perform the scan operation on the display regions 115 that are adjacent to each other in the scan direction. For example, as illustrated in FIG. 4, the display panel driving circuit 120 may perform the scan operation on the display regions 115-11, 115-12, and 115-13 (e.g., the upper display region), may then perform the scan operation on the display regions 115-21, 115-22, and 115-23 (e.g., the middle display region), and then may perform the scan operation on the display regions 115-31, 115-32, and 115-33 (e.g., the lower display region). Similarly, as illustrated in FIG. 5, the display panel driving circuit 120 may perform the scan operation on the display region 115-1, may perform the scan operation on the display region 115-2, and then may perform the scan operation on the display region 115-3.

Thus, as illustrated in FIG. 6, after the scan operation is sequentially performed on the pixel circuits 111 included in an upper display region (e.g., indicated in FIG. 6 by "UPPER REGION") of the display panel 110 in the scan direction (e.g., indicated in FIG. 6 by "SCAN DIRECTION"), the scan operation may be sequentially performed on the pixel circuits 111 included in a middle display region (e.g., indicated in FIG. 6 by "MIDDLE REGION") of the display panel 110 in the scan direction. In addition, after the scan operation is sequentially performed on the pixel circuits 111 included in the middle display region of the display panel 110 in the scan direction, the scan operation may be sequentially performed on the pixel circuits 111 included in a lower display region (e.g., indicated in FIG. 6 by "LOWER REGION") of the display panel 110 in the scan direction.

As described above, because the scan operation is connectively performed on the display regions 115 that are adjacent to each other in the scan direction, the display panel driving circuit 120 may start the emission operation for each of display regions 115 after the scan operation on all display regions 115 (e.g., on all pixel circuits 111 included in the display panel 110) is finished (e.g., indicated in FIG. 6 by "SCAN FINISH").

Thus, the display panel driving circuit 120 may set a starting point of the emission period EMP for each of the display regions 115 to the same point, where the emission operation is performed in the emission period EMP. That is, because the display panel driving circuit 120 starts the emission operation for each of the display regions 115 after the scan operation on all pixel circuits 111 included in the display panel 110 is finished, the display panel driving circuit 120 might not set the starting point of the emission period EMP (e.g., an ending point of the scan period SP) for each of the display regions 115 to different points. Hence, the display panel driving circuit 120 may change the length of the emission period EMP by moving a respective ending point of the emission period EMP for each of the display regions 115 based on the region grayscale that each of the display regions 115 is to implement.

For example, as illustrated in FIG. 7, when the region grayscale that the display region 115 is to implement is the reference grayscale (e.g., indicated in FIG. 7 by "MGY"), the display panel driving circuit 120 may determine the length of the emission period EMP for the display region 115 as the reference length REFL corresponding to a length between a reference starting point EMS and a reference ending point EMF. In addition, when the region grayscale that the display region 115 is to implement is a high grayscale (e.g., indicated in FIG. 7 by "HGY"), the display panel driving circuit 120 may fix the starting point of the emission period EMP for the display region 115 to the reference stating point EMS, and may increase the length of the emission period EMP for the display region 115 by moving the ending point of the emission period EMP for the display region 115 from the reference ending point EMF to a first ending point EMF1 (e.g., indicated in FIG. 7 by "INC").

Furthermore, when the region grayscale that the display region 115 is to implement is a low grayscale (e.g., indicated in FIG. 7 by "LGY"), the display panel driving circuit 120 may fix the starting point of the emission period EMP for the display region 115 to the reference stating point EMS, and may decrease the length of the emission period EMP for the display region 115 by moving the ending point of the emission period EMP for the display region 115 from the reference ending point EMF to a second ending point EMF2 (e.g., indicated in FIG. 7 by "DEC").

To briefly summarize, the length of the emission period EMP for each of the display regions 115 may be changed in one frame. However, because a driving frequency of the display panel 110 is generally more than 90 Hz, a user (or, viewer) cannot recognize a flicker, etc. due to a change in the length of the emission period EMP for each of the display regions 115.

Figure 8:
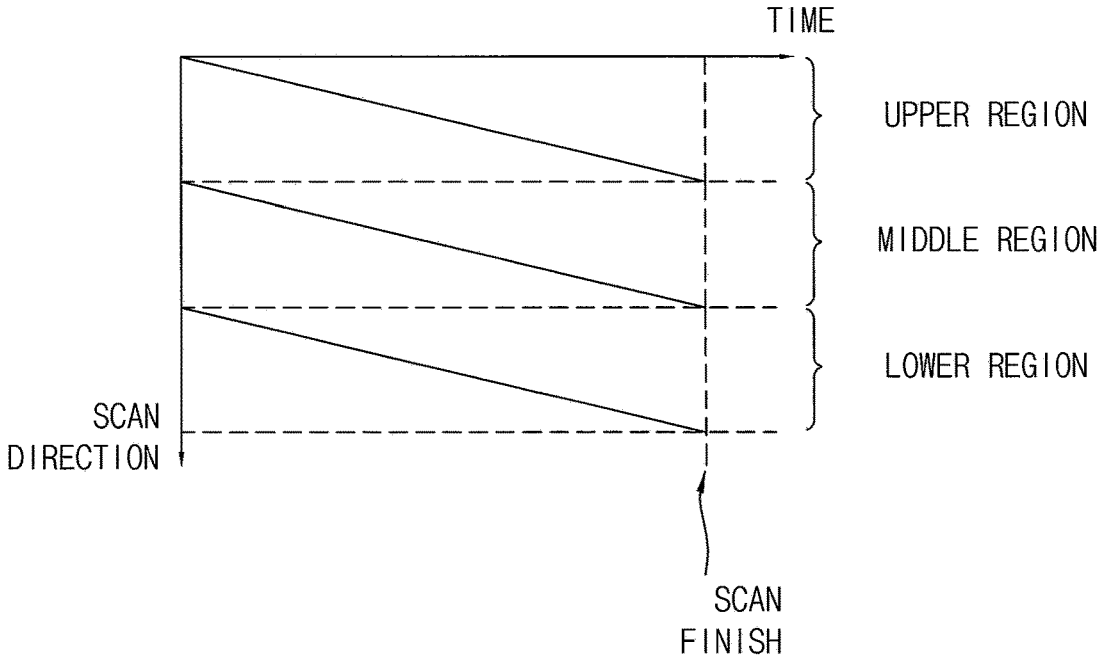
FIG. 8 is a diagram for describing that a display panel driving circuit included in the display device of FIG. 1 separately performs a scan operation on display regions that are adjacent to each other in a scan direction.
Figure 9:
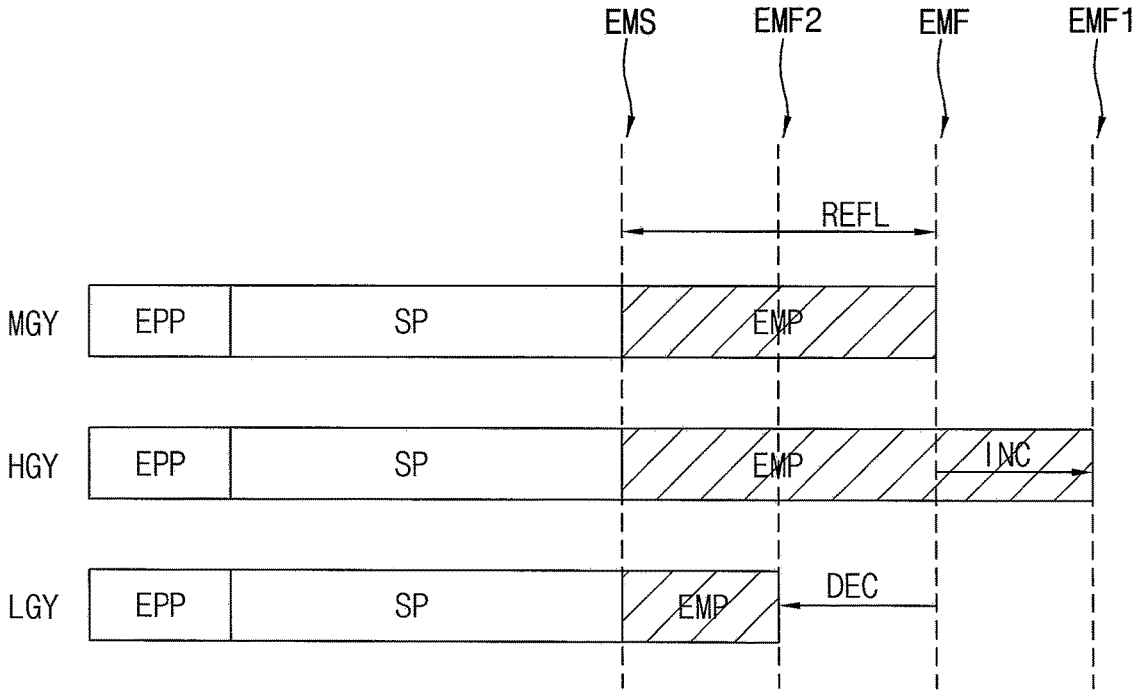
FIG. 9 is a diagram illustrating an example in which a display panel driving circuit included in the display device of FIG. 1 changes a length of an emission period for each of display regions that are adjacent to each other in a scan direction when separately performing a scan operation on the display regions.
Figure 10:
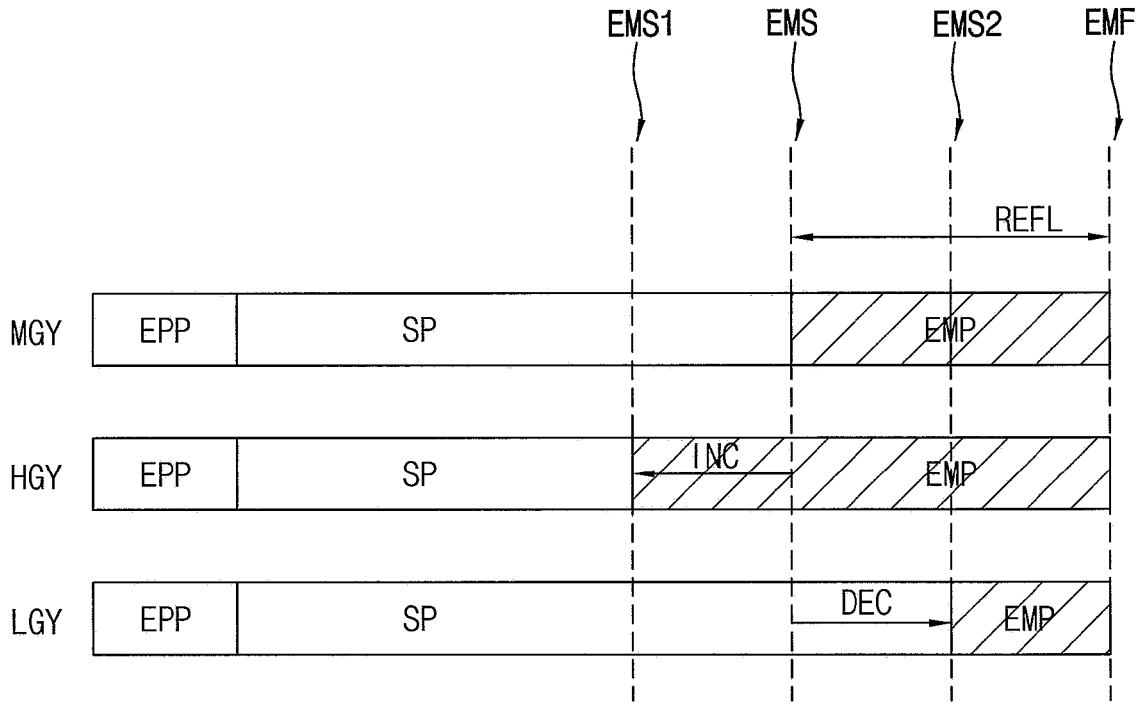
FIG. 10 is a diagram illustrating another example in which a display panel driving circuit included in the display device of FIG. 1 changes a length of an emission period for each of display regions that are adjacent to each other in a scan direction when separately performing a scan operation on the display regions.
Figure 11:
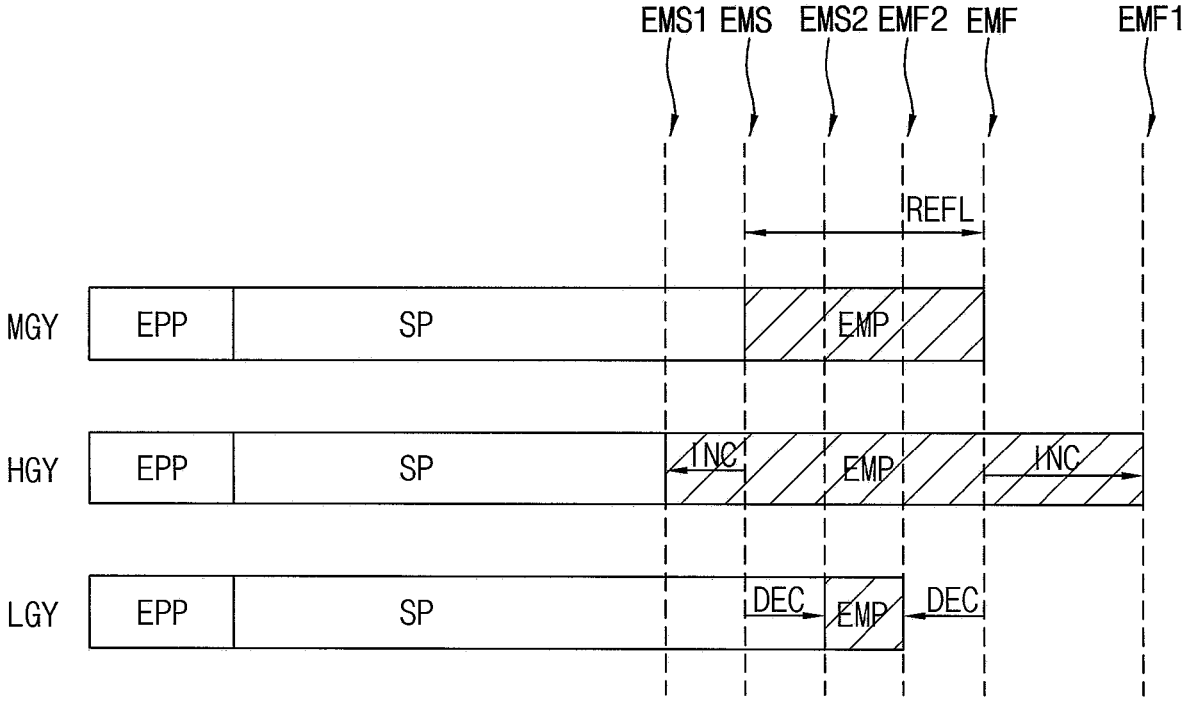
FIG. 11 is a diagram illustrating still another example in which a display panel driving circuit included in the display device of FIG. 1 changes a length of an emission period for each of display regions that are adjacent to each other in a scan direction when separately performing a scan operation on the display regions.

FIG. 8 is a diagram for describing that a display panel driving circuit included in the display device of FIG. 1 separately performs a scan operation on display regions that are adjacent to each other in a scan direction, and FIGS. 9 to 11 are diagrams illustrating various examples in which a display panel driving circuit included in the display device of FIG. 1 changes a length of an emission period for each of display regions that are adjacent to each other in a scan direction when separately performing a scan operation on the display regions.

Referring to FIGS. 8 to 11, the display panel driving circuit 120 may separately perform the scan operation on the display regions 115 that are adjacent to each other in the scan direction. For example, as illustrated in FIG. 4, the display panel driving circuit 120 may perform the scan operation on the display regions 115-11, 115-12, and 115-13 (e.g., the upper display region), the scan operation on the display regions 115-21, 115-22, and 115-23 (e.g., the middle display region), and the scan operation on the display regions 115-31, 115-32, and 115-33 (e.g., the lower display region) at the same time (e.g., in parallel). Similarly, as illustrated in FIG. 5, the display panel driving circuit 120 may perform the scan operation on the display region 115-1, the scan operation on the display region 115-2, and the scan operation on the display region 115-3 at the same time (e.g., in parallel).

Thus, as illustrated in FIG. 8, when the scan operation on the pixel circuits 111 included in the upper display region (e.g., indicated in FIG. 8 by "UPPER REGION") is started, the scan operation on the pixel circuits 111 included in the middle display region (e.g., indicated in FIG. 8 by "MIDDLE REGION") and the scan operation on the pixel circuits 111 included in the lower display region (e.g., indicated in FIG. 8 by "LOWER REGION") may also be started. Here, in each of the upper display region, the middle display region, and the lower display region of the display panel 110, the scan operation may be performed on the pixel circuits 111 in a sequence of scan-lines in the scan direction (e.g., indicated in FIG. 8 by "SCAN DIRECTION").

To this end, as illustrated in FIG. 4, the display panel driving circuit 120 may include a first display panel driving block (e.g., a first scan driver and a first data driver) that performs the scan operation and the data-providing operation on the display regions 115-11, 115-12, and 115-13 (e.g., the upper display region), a second display panel driving block (e.g., a second scan driver and a second data driver) that performs the scan operation and the data-providing operation on the display regions 115-21, 115-22, and 115-23

(e.g., the middle display region), and a third display panel driving block (e.g., a third scan driver and a third data driver) that performs the scan operation and the data-providing operation on the display regions 115-31, 115-32, and 115-33 (e.g., the lower display region). Similarly, as illustrated in FIG. 5, the display panel driving circuit 120 may include a first display panel driving block that performs the scan operation on the display region 115-1, a second display panel driving block that performs the scan operation on the display region 115-2, and a third display panel driving block that performs the scan operation on the display regions 115-3.

As described above, because the scan operation is separately performed on the display regions 115, the scan period SP in which the scan operation is performed may be equal for the display regions 115 or may be different for the display regions 115. That is, although it is illustrated in FIG. 8 that the scan operation on the pixel circuits 111 included in the upper display region of the display panel 110, the scan operation on the pixel circuits 111 included in the middle display region of the display panel 110, and the scan operation on the pixel circuits 111 included in the lower display region of the display panel 110 are finished (or, completed) at the same time (e.g., indicated in FIG. 8 by "SCAN FINISH"), the scan operation on the pixel circuits 111 included in the upper display region of the display panel 110, the scan operation on the pixel circuits 111 included in the middle display region of the display panel 110, and the scan operation on the pixel circuits 111 included in the lower display region of the display panel 110 may be finished at different times.

For example, when the scan operation on the pixel circuits 111 included in the upper display region of the display panel 110, the scan operation on the pixel circuits 111 included in the middle display region of the display panel 110, and the scan operation on the pixel circuits 111 included in the lower display region of the display panel 110 are performed based on respective scan signals SS having different clock frequencies, the scan operation performed based on the scan signal SS having a high clock frequency may be finished first (e.g., the length of the scan period SP may be relatively short), and the scan operation performed based on the scan signal SS having a low clock frequency may be finished later (e.g., the length of the scan period SP may be relatively long).

As described above, because the scan operation is separately performed on the display regions 115 that are adjacent to each other in the scan direction, the display panel driving circuit 120 may finish respective scan operations for the display regions 115 at different times, and thus may start respective emission operations for the display regions 115 at different times. In other words, the display panel driving circuit 120 may differently set the starting point of the emission period EMP for each of the display regions 115.

In an embodiment, as illustrated in FIG. 9, the display panel driving circuit 120 may set the starting point of the emission period EMP (e.g., may set the ending point of the scan period SP) for each of the display regions 115 to the same point, and may change the length of the emission period EMP for each of the display regions 115 by moving the ending point of the emission period EMP for each of the display regions 115 based on the region grayscale that each of the display regions 115 is to implement.

For example, when the region grayscale that the display region 115 is to implement is the reference grayscale (e.g., indicated in FIG. 9 by "MGY"), the display panel driving circuit 120 may determine the length of the emission period EMP for the display region 115 as the reference length REFL corresponding to the length between the reference starting point EMS and the reference ending point EMF. In addition, when the region grayscale that the display region 115 is to implement is a high grayscale (e.g., indicated in FIG. 9 by "HGY"), the display panel driving circuit 120 may fix the starting point of the emission period EMP for the display region 115 to the reference stating point EMS, and may increase the length of the emission period EMP for the display region 115 by moving the ending point of the emission period EMP for the display region 115 from the reference ending point EMF to the first ending point EMF1 (e.g., indicated in FIG. 9 by "INC").

Furthermore, when the region grayscale that the display region 115 is to implement is a low grayscale (e.g., indicated in FIG. 9 by "LGY"), the display panel driving circuit 120 may fix the starting point of the emission period EMP for the display region 115 to the reference stating point EMS, and may decrease the length of the emission period EMP for the display region 115 by moving the ending point of the emission period EMP for the display region 115 from the reference ending point EMF to the second ending point EMF2 (e.g., indicated in FIG. 9 by "DEC"). In brief, the length of the emission period EMP for each of the display regions 115 may be changed in one frame. However, because the driving frequency of the display panel 110 is generally more than 90 Hz, a user (or, viewer) cannot recognize a flicker, etc. due to a change in the length of the emission period EMP for each of the display regions 115.

In another embodiment, as illustrated in FIG. 10, the display panel driving circuit 120 may set the ending point of the emission period EMP for each of the display regions 115 to the same point, and may change the length of the emission period EMP for each of the display regions 115 by moving the starting point of the emission period EMP (e.g., by moving the ending point of the scan period SP) for each of the display regions 115 based on the region grayscale that each of the display regions 115 is to implement.

For example, when the region grayscale that the display region 115 is to implement is the reference grayscale (e.g., indicated in FIG. 10 by "MGY"), the display panel driving circuit 120 may determine the length of the emission period EMP for the display region 115 as the reference length REFL corresponding to the length between the reference starting point EMS and the reference ending point EMF. In addition, when the region grayscale that the display region 115 is to implement is a high grayscale (e.g., indicated in FIG. 10 by "HGY"), the display panel driving circuit 120 may fix the ending point of the emission period EMP for the display region 115 to the reference ending point EMF, and may increase the length of the emission period EMP for the display region 115 by moving the starting point of the emission period EMP (e.g., by moving the ending point of the scan period SP) for the display region 115 from the reference starting point EMS to the first starting point EMS1 (e.g., indicated in FIG. 10 by "INC").

Furthermore, when the region grayscale that the display region 115 is to implement is a low grayscale (e.g., indicated in FIG. 10 by "LGY"), the display panel driving circuit 120 may fix the ending point of the emission period EMP for the display region 115 to the reference ending point EMF, and may decrease the length of the emission period EMP for the display region 115 by moving the starting point of the emission period EMP (e.g., by moving the ending point of the scan period SP) for the display region 115 from the reference starting point EMS to the second starting point EMS2 (e.g., indicated in FIG. 10 by "DEC"). In brief, the length of the emission period EMP for each of the display regions 115 may be changed in one frame. However, because the driving frequency of the display panel 110 is generally more than 90 Hz, the user cannot recognize the flicker, etc. due to the change in the length of the emission period EMP for each of the display regions 115.

In still another embodiment, as illustrated in FIG. 11, the display panel driving circuit 120 may change the length of the emission period EMP for each of the display regions 115 by moving both the starting point and the ending point of the emission period EMP for each of the display regions 115 based on the region grayscale that each of the display regions 115 is to implement. For example, when the region grayscale that the display region 115 is to implement is the reference grayscale (e.g., indicated in FIG. 11 by "MGY"), the display panel driving circuit 120 may determine the length of the emission period EMP for the display region 115 as the reference length REFL corresponding to the length between the reference starting point EMS and the reference ending point EMF.

In addition, when the region grayscale that the display region 115 is to implement is a high grayscale (e.g., indicated in FIG. 11 by "HGY"), the display panel driving circuit 120 may increase the length of the emission period EMP for the display region 115 by moving the starting point of the emission period EMP (e.g., by moving the ending point of the scan period SP) for the display region 115 from the reference starting point EMS to the first starting point EMS1 (e.g., indicated in FIG. 11 by "INC" on the left) and by moving the ending point of the emission period EMP for the display region 115 from the reference ending point EMF to the first ending point EMF1 (e.g., indicated in FIG. 11 by "INC" on the right).

Furthermore, when the region grayscale that the display region 115 is to implement is a low grayscale (e.g., indicated in FIG. 11 by "LGY"), the display panel driving circuit 120 may decrease the length of the emission period EMP for the display region 115 by moving the starting point of the emission period EMP (e.g., by moving the ending point of the scan period SP) for the display region 115 from the reference starting point EMS to the second starting point EMS2 (e.g., indicated in FIG. 11 by "DEC" on the left) and by moving the ending point of the emission period EMP for the display region 115 from the reference ending point EMF to the second ending point EMF2 (e.g., indicated in FIG. 11 by "DEC" on the right).

To briefly summarize, the length of the emission period EMP for each of the display regions 115 may be changed in one frame. However, because the driving frequency of the display panel 110 is generally more than 90 Hz, the user cannot recognize the flicker, etc. due to the change in the length of the emission period EMP for each of the display regions 115.

Figure 12:
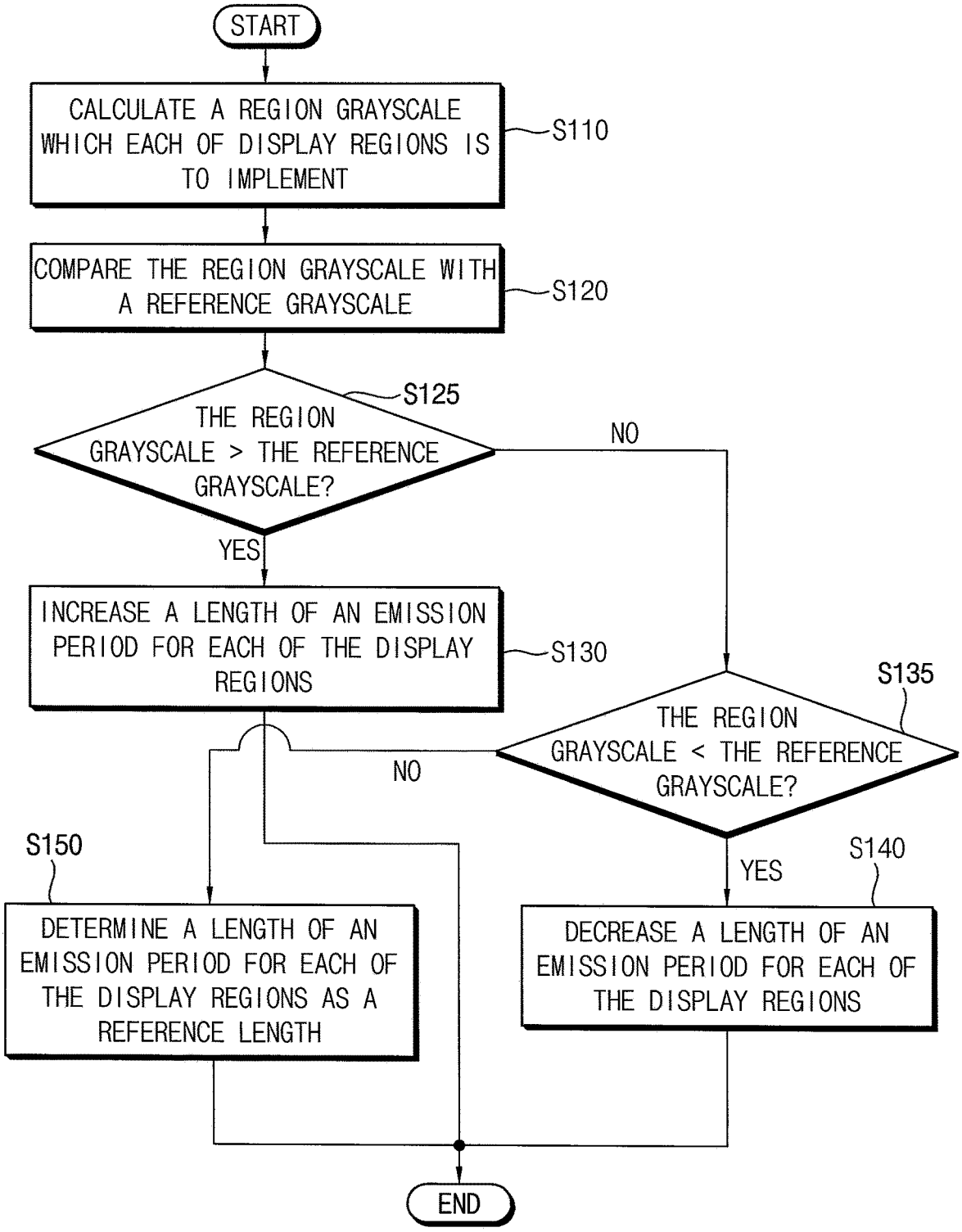
FIG. 12 is a flowchart illustrating a method of driving a display panel according to one or more embodiments.

FIG. 12 is a flowchart illustrating a method of driving a display panel according to one or more embodiments.

Referring to FIG. 12, the method of FIG. 12 may drive a display panel including display regions, where the display regions are formed by grouping pixel circuits included in the display panel, by sequentially performing an emission preparation operation, a scan operation, and an emission operation for the pixel circuits.

For example, the method of FIG. 12 may calculate a region grayscale that each of the display regions is to implement (S110) by analyzing grayscale data to be applied to the pixel circuits included in each of the display regions. In an embodiment, the region grayscale that each of the display regions is to implement may be calculated as an average value of grayscales that the pixel circuits included in each of the display regions are to implement. In another embodiment, the region grayscale that each of the display regions is to implement may be calculated as a weighted average value of grayscales that the pixel circuits included in each of the display regions are to implement. In still another embodiment, the region grayscale that each of the display regions is to implement may be calculated as a minimum value of grayscales that the pixel circuits included in each of the display regions are to implement. In still another embodiment, the region grayscale that each of the display regions is to implement may be calculated as a maximum value of grayscales that the pixel circuits included in each of the display regions are to implement.

Subsequently, the method of FIG. 12 may compare the region grayscale that each of the display regions is to implement with a reference grayscale (S120). Next, the method of FIG. 12 may check whether the region grayscale that each of the display regions is to implement is higher than the reference grayscale (S125). Here, when the region grayscale that each of the display regions is to implement is higher than the reference grayscale, the method of FIG. 12 may increase a length of an emission period for each of the display regions by a change-amount corresponding to a difference between the region grayscale and the reference grayscale, where an emission operation is performed in the emission period (S130).

Contrastingly, when the region grayscale that each of the display regions is to implement is not higher than the reference grayscale, the method of FIG. 12 may check whether the region grayscale that each of the display regions is to implement is lower than the reference grayscale (S135). Here, when the region grayscale that each of the display regions is to implement is lower than the reference grayscale, the method of FIG. 12 may decrease the length of the emission period for each of the display regions by the change-amount corresponding to the difference between the region grayscale and the reference grayscale (S140).

On the other hand, when the region grayscale that each of the display regions is to implement is not lower than the reference grayscale (e.g., when the region grayscale that each of the display regions is to implement is equal to the reference grayscale), the method of FIG. 12 may determine the length of the emission period for each of the display regions as a reference length (S150).

As described above, the method of FIG. 12 may increase the length of the emission period for each of the display regions as the region grayscale that each of the display regions is to implement increases, and may decrease the length of the emission period for each of the display regions as the region grayscale that each of the display regions is to implement decreases. In an embodiment, the method of FIG. 12 may linearly increase or decrease the length of the emission period for each of the display regions based on the region grayscale that each of the display regions is to implement. In this case, the length of the emission period may be increased or decreased at the same rate in an entire grayscale range of the region grayscale. In another embodiment, the method of FIG. 12 may non-linearly increase or decrease the length of the emission period for each of the display regions based on the region grayscale that each of the display regions is to implement. In this case, the length of the emission period may be sharply increased or decreased in a particular grayscale range of the region grayscale, and the length of the emission period may be gradually increased or decreased in another particular grayscale range of the region grayscale. In still another embodiment, the method of FIG. 12 may discretely increase or decrease the length of the emission period for each of the display regions based on the region grayscale that each of the display regions is to implement. In this case, the length of the emission period may be increased or decreased in a stepwise form based on the region grayscale.

In an embodiment, the method of FIG. 12 may increase or decrease the length of the emission period for each of the display regions by moving an ending point of the emission period for each of the display regions. Here, the method of FIG. 12 may fix a starting point of the emission period for each of the display regions. In another embodiment, the method of FIG. 12 may increase or decrease the length of the emission period for each of the display regions by moving the starting point of the emission period for each of the display regions. Here, the method of FIG. 12 may fix the ending point of the emission period for each of the display regions. In still another embodiment, the method of FIG. 12 may increase or decrease the length of the emission period for each of the display regions by moving both the starting point and the ending point of the emission period for each of the display regions.

Because these embodiments are described with reference to FIGS. 6 to 11, duplicated description will not be repeated.

Figure 13:
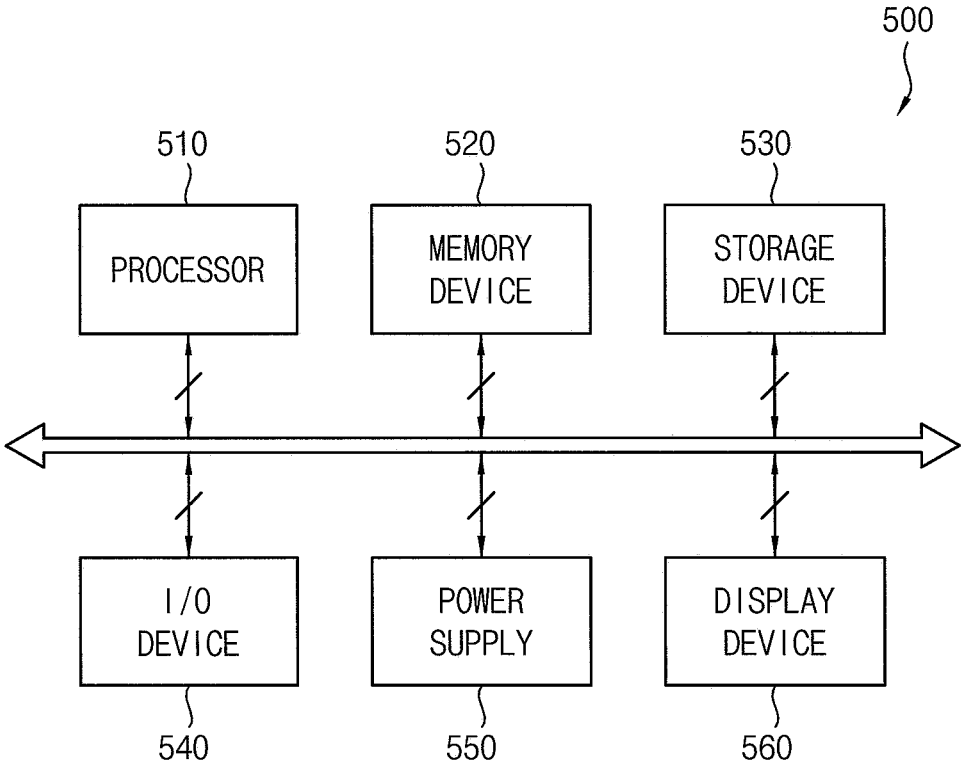
FIG. 13 is a block diagram illustrating an electronic device according to one or more embodiments.
Figure 14:
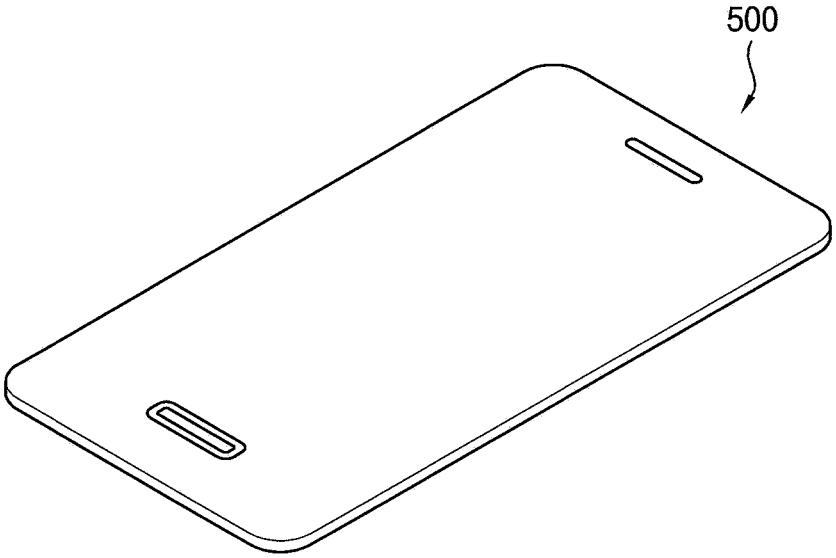
FIG. 14 is a diagram illustrating an example in which the electronic device of FIG. 13 is implemented as a smart phone.
Figure 15:
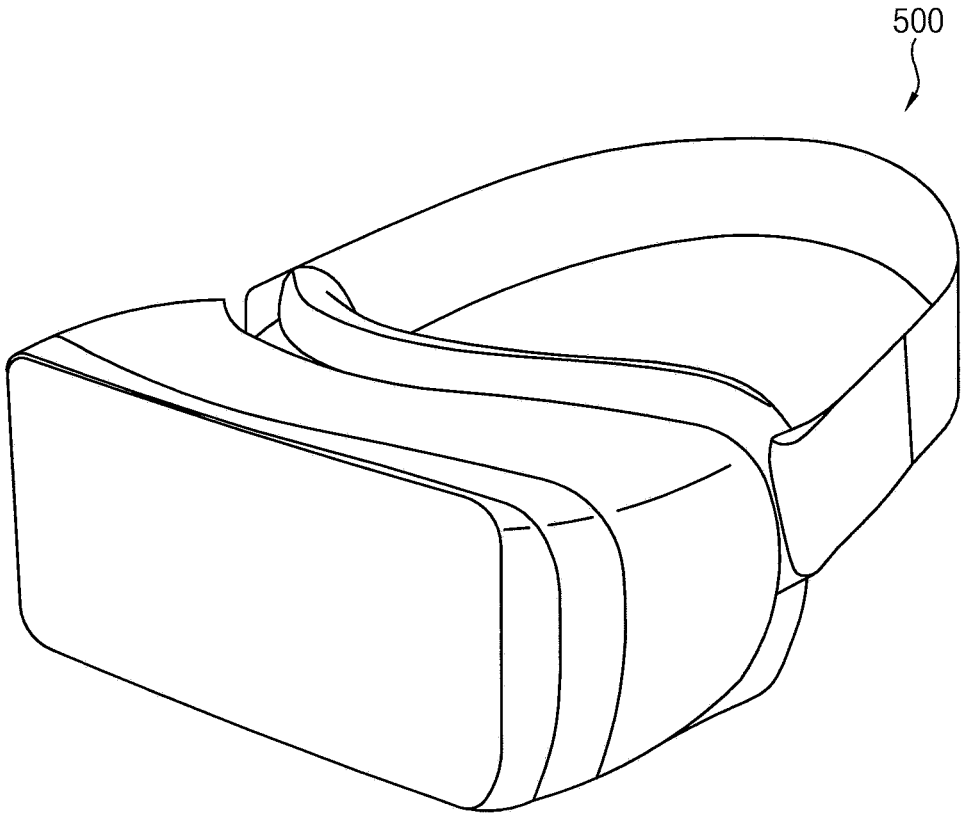
FIG. 15 is a diagram illustrating an example in which the electronic device of FIG. 13 is implemented as a head mounted display (HMD) device.

FIG. 13 is a block diagram illustrating an electronic device according to one or more embodiments, FIG. 14 is a diagram illustrating an example in which the electronic device of FIG. 13 is implemented as a smart phone, and FIG. 15 is a diagram illustrating an example in which the electronic device of FIG. 13 is implemented as a head mounted display (HMD) device.

Referring to FIGS. 13 to 15, the electronic device 500 may include a processor 510, a memory device 520, a storage device 530, an input/output (I/O) device 540, a power supply 550, and a display device 560. Here, the display device 560 may be the display device 100 of FIG. 1. In an embodiment, the display device 560 may be an organic light emitting display device in which each pixel circuit includes an organic light emitting diode. However, the display device 560 is not limited thereto. In addition, the electronic device 500 may further include a plurality of ports for communicating with a video card, a sound card, a memory card, a universal serial bus (USB) device, other electronic devices, etc. In an embodiment, as illustrated in FIG. 14, the electronic device 500 may be implemented as the smart phone. In another embodiment, as illustrated in FIG. 15, the electronic device 500 may be implemented as the HMD device. However, the electronic device 500 is not limited thereto. For example, the electronic device 500 may be implemented as a cellular phone, a video phone, a smart pad, a smart watch, a tablet PC, a car navigation system, a television, a computer monitor, a laptop, etc.

The processor 510 may perform various computing functions. The processor 510 may be a microprocessor, a central processing unit (CPU), an application processor (AP), etc. The processor 510 may be coupled to other components via an address bus, a control bus, a data bus, etc. Further, the processor 510 may be coupled to an extended bus such as a peripheral component interconnection (PCI) bus. The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 530 may be a solid state drive (SSD) device, a hard disk drive (HDD) device, a CD-ROM device, etc. The I/O device 540 may be an input device such as a keyboard, a keypad, a mouse device, a touchpad, a touch-screen, etc., and an output device such as a printer, a speaker, etc. In some embodiments, the display device 560 may be included in the I/O device 540. The power supply 550 may provide power for operations of the electronic device 500.

The display device 560 may be coupled to other components via the buses or other communication links. As described above, the display device 560 may include a display panel and a display panel driving circuit. For example, the display panel includes a plurality of pixel circuits each having a light-emitting element. Here, the display panel may be divided into a plurality of display regions that are formed by grouping the pixel circuits. The display panel driving circuit may drive the display panel by sequentially performing an emission preparation operation, a scan operation, and an emission operation for the pixel circuits. Here, the emission operation may be performed independently on respective display regions. To this end, the display panel driving circuit may provide independent emission control signals to the display regions included in the display panel, and the pixel circuits included in each of the display regions may simultaneously or concurrently perform an emission operation (e.g., may emit light at the same time and may emit no light at the same time) in response to the emission control signal provided to each of the display regions. For example, the pixel circuits included in a first display region may simultaneously or concurrently perform the emission operation in response to a first emission control signal provided to the first display region, the pixel circuits included in a second display region may simultaneously or concurrently perform the emission operation in response to a second emission control signal provided to the second display region, and the pixel circuits included in a (k)-th display region may simultaneously or concurrently perform the emission operation in response to a (k)-th emission control signal provided to the (k)-th display region. Thus, in each frame, the display panel driving circuit may calculate a region grayscale that each of the display regions is to implement by analyzing grayscale data to be applied to the pixel circuits included in each of the display regions and may change a length of an emission period for each of the display regions based on the region grayscale that each of the display regions is to implement, where the emission operation is performed in the emission period. For example, the display panel driving circuit may increase the length of the emission period for each of the display regions as the region grayscale that each of the display regions is to implement increases and may decrease the length of the emission period for each of the display regions as the region grayscale that each of the display regions is to implement decreases. As a result, the display device 560 may achieve high luminance by increasing the emission time for the display region that implements a high grayscale and may reduce power consumption by decreasing the emission time for the display region that implements a low grayscale. Because these are described above, duplicated description will not be repeated.

The present inventive concept may be applied to a display device and an electronic device including the display device. For example, the present inventive concept may be applied to a cellular phone, a smart phone, a video phone, a smart pad, a smart watch, a tablet PC, a car navigation system, a television, a computer monitor, a laptop, a digital camera, an HMD device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, including functional equivalents as well as other embodiments, are intended to be included within the scope of the appended claims.

What is claimed is:

1. A display device comprising:

a display panel comprising a plurality of pixel circuits each having a light-emitting element, the display panel being divided into a plurality of display regions comprising respective groups of the pixel circuits; and a display panel driving circuit configured to drive the display panel by sequentially performing an emission preparation operation, a scan operation, and an emission operation for the pixel circuits, and configured to perform the emission operation independently on each of the display regions, wherein, in each frame, the display panel driving circuit is configured to calculate a region grayscale that each of the display regions is to implement by analyzing grayscale data to be applied to the pixel circuits in each of the display regions, to move a starting point of an emission period for one or more of the display regions to change a length of the emission period for the one or more of the display regions based on the calculated region grayscale, and to set an ending point of the emission period for each of the display regions to a same point, the emission operation being performed in the emission period.

2. The display device of claim 1, wherein the display panel driving circuit is configured to increase the length of the emission period for a corresponding one of the display regions as the region grayscale increases, and is configured to decrease the length of the emission period for a corresponding one of the display regions as the region grayscale decreases.

3. The display device of claim 2, wherein the display panel driving circuit is configured to connectively perform the scan operation on the display regions that are adjacent to each other in a scan direction.

4. The display device of claim 2, wherein the display panel driving circuit is configured to separately perform the scan operation on the display regions that are adjacent to each other in a scan direction.

5. The display device of claim 2, wherein the display panel driving circuit is configured to linearly increase or linearly decrease the length of the emission period for each of the display regions.

6. The display device of claim 2, wherein the display panel driving circuit is configured to non-linearly increase or non-linearly decrease the length of the emission period for each of the display regions.

7. The display device of claim 2, wherein the display panel driving circuit is configured to discretely increase or discretely decrease the length of the emission period for each of the display regions.

8. The display device of claim 1, wherein the display panel driving circuit is configured to calculate a difference between the region grayscale and a reference grayscale, and is configured to determine the length of the emission period for each of the display regions based on the difference.

9. The display device of claim 8, wherein the display panel driving circuit is configured to calculate the region grayscale as an average value of grayscales that the pixel circuits in each of the display regions are to implement.

10. The display device of claim 8, wherein the display panel driving circuit is configured to calculate the region grayscale as a weighted average value of grayscales that the pixel circuits in each of the display regions are to implement.

11. The display device of claim 8, wherein the display panel driving circuit is configured to calculate the region grayscale as a minimum value of grayscales that the pixel circuits in each of the display regions are to implement.

12. The display device of claim 8, wherein the display panel driving circuit is configured to calculate the region grayscale as a maximum value of grayscales that the pixel circuits in each of the display regions are to implement.

13. A display device comprising:

a display panel comprising a plurality of pixel circuits each having a light-emitting element, the display panel being divided into a plurality of display regions comprising respective groups of the pixel circuits; and a display panel driving circuit configured to drive the display panel by sequentially performing an emission preparation operation, a scan operation, and an emission operation for the pixel circuits, and configured to perform the emission operation independently on each of the display regions, wherein, in each frame, the display panel driving circuit is configured to calculate a region grayscale that each of the display regions is to implement by analyzing grayscale data to be applied to the pixel circuits in each of the display regions, and to move both a starting point and an ending point of an emission period for one or more of the display regions based on the region grayscale to change a length of the emission period for the one or more of the display regions, the emission operation being performed in the emission period.

14. A method of driving a display panel that comprises a plurality of display regions comprising respective groups of a plurality of pixel circuits in the display panel, where the display panel is driven by sequentially performing an emission preparation operation, a scan operation, and an emission operation for the pixel circuits, the method comprising:

calculating a region grayscale that each of the display regions is to implement by analyzing grayscale data to be applied to the pixel circuits in each of the display regions;

comparing the region grayscale with a reference grayscale;

increasing a length of an emission period for each of the display regions by a change-amount corresponding to a difference between the region grayscale and the reference grayscale when the region grayscale is higher than the reference grayscale, the emission operation being performed in the emission period;

determining the length of the emission period for each of the display regions as a reference length when the region grayscale is equal to the reference grayscale;

decreasing the length of the emission period for each of the display regions by the change-amount corresponding to the difference between the region grayscale and the reference grayscale when the region grayscale is lower than the reference grayscale;

moving a starting point of the emission period for one or more of the display regions; and fixing an ending point of the emission period for each of the display regions.

* * * * *